United States Patent [19]

Poldervaart

[11] Patent Number: 4,798,155

[45] Date of Patent: Jan. 17, 1989

[54] MOORING DEVICE

[75] Inventor: Leendert Poldervaart, La Turbie, France

[73] Assignee: Single Buoy Moorings, Inc., Marly, Switzerland

[21] Appl. No.: 606,515

[22] Filed: May 3, 1984

[30] Foreign Application Priority Data

May 3, 1983 [NL] Netherlands ..... 8301558

[51] Int. Cl.[4] ..... B63B 21/50

[52] U.S. Cl. ..... 114/230; 441/3

[58] Field of Search ..... 114/330; 441/3–5

[56] References Cited

U.S. PATENT DOCUMENTS

| | | | |
|---|---|---|---|
| 3,259,927 | 7/1966 | Devis | 441/3 |
| 3,440,671 | 4/1969 | Smulders | 114/230 X |
| 4,088,089 | 5/1978 | Flory | 114/230 |
| 4,106,146 | 8/1978 | Maari | 114/230 |
| 4,625,673 | 12/1986 | Faller et al. | 441/3 |

FOREIGN PATENT DOCUMENTS

| | | | |
|---|---|---|---|
| 2420475 | 10/1979 | France . | |
| 2418146 | 6/1984 | France . | |
| 165422 | 12/1973 | Netherlands . | |
| 7414432 | 5/1976 | Netherlands . | |
| 7611741 | 6/1977 | Netherlands . | |
| 7614397 | 7/1977 | Netherlands . | |
| 7612046 | 5/1978 | Netherlands . | |
| 7802200 | 8/1979 | Netherlands . | |
| 7901416 | 9/1979 | Netherlands . | |
| 8202334 | 8/1982 | Netherlands . | |
| 8202335 | 8/1982 | Netherlands . | |
| 8100936 | 9/1982 | Netherlands . | |
| 2015455 | 9/1979 | United Kingdom . | |
| 2019800 | 11/1979 | United Kingdom | 114/230 |

OTHER PUBLICATIONS

"The Mooring of a Tanker to a Single Point Mooring by a Rigid Yoke", L. H. Smulders and G. F. Remery of Single Buoy Moorings, Inc., 1979.

*Primary Examiner*—Sherman D. Basinger

*Attorney, Agent, or Firm*—Young & Thompson

[57] ABSTRACT

The present invention relates to a mooring system comprising a floating device with or without storage capacity and to which another ship can be moored which floating device has been connected with an anchor or the like in a manner such that in case of displacements of the floating device a return force is generated from structure which is under vertical tension, the improvement being that the structure which generates the return force is placed inside a space within the hull of the floating device and which is protected with respect to the surroundings.

14 Claims, 9 Drawing Sheets

MOORING DEVICE

The invention relates to a mooring device comprising a floating device with our without storage capacity, such as a tanker, to which another vessel can be moored, at least one anchor placed upon the sea bottom or an upwardly directed body attached to it, and between tanker and the anchor or body respectively a resilient connection having means generating a return force in case the tanker is displaced with respect to the anchor or anchors or the body respectively.

Mooring device of this type are known in many forms. Examples can be found in the article "The Mooring of a Tanker to a Single Point Mooring by a rigid Yoke" of L.H. Smulders and C.C. Remery, published in the "Offshore Technology Conference Report", 3567 of the 11th Annual Offshore Technology Conference in Houston, 1977, e.g. in the FIGS. 5 and 6. Other Examples are found in e.g. the French patent specification No. 2,418,146, the British patent specification No. 20 15 455, the published Dutch patent application No. 8100936, the published Dutch patent application Nos. 8202334 and 8202335 and many other publications.

In all said known mooring devices the means for generating the return force, such as the buoy, the tower, the tension-resistant connection with a bottom anchor, all are provided at a distance from the tanker, in many cases a distance, which is bridged over by a rigid arm connected to the tanker, and in one or another way with the anchored body. As a consequence of this said means are in no way protected against weather circumstances, e.g. against floating ice and the distance which has to be bridged over by medium transporting conduits and hoses is large. The relative movements between the connections with the anchor or anchors and the center of the floating device are largest if the distance of said connections to the center is large. In case of breakage of the hoses the result is again polution of the sea.

Purpose of the invention is to provide a mooring device which in many respects is more advantageous than the known solutions.

According to the invention this purpose is achieved in that the means generating the return force are placed inside a space in the hull of the tanker which space all around is protected laterally with respect to the outside water, which space contains liquid.

According to the invention the tanker, at a place which is as advantageous as possible and which as a rule will be adjacent to the bow, is provided with an open space, which in its most simple form is open at the bottom and top and inside which the means are provided generating the return force, which means may have a known form, but also may be formed by new embodiments to be discussed later.

Said location of the return force generating means inside the protected space has as a result that said means are protected against waves and ice, that in case of breakage of a hose or conduit the oil flowing out will be collected in said space and can be pumped away from it.

Accordingly polution of the sea no longer can take place and finally the distance to the center is smaller which reduces the occuring forces.

The means for generating the return force in general terms can be divided into means the operation of which is based upon the buoyancy of a buoy or a float, which in upwards direction acts upon a tension-resistant connection extending towards a bottom anchor or acts upon a tower which at its foot has been pivotably connected respectively, or from means the operation of which is based on forces derived from weights.

Thus from the published Dutch patent application No. 7414432 a mooring device is known in which the means for generating the return force comprise an arm pivotably about a horizontal axis connected to the tanker and a body having buoyancy connected to the arm which arm has a tension-resistant connection with a bottom anchor.

According to the invention the body with buoyancy is placed in the protected space and the arm extends outboard and there has been connected with the tension-resistant connection.

However, it is equally well possible to provide the arm as well as the body with buoyancy inside the protected space and to let the tension-resistant connection with the bottom anchor extend downwardly through the open underside of the protected space.

If the arm extends outboard then it is possible to use a protected space which is closed at the bottom and then in said protected space one can operate with a liquid which differs from the outside water, such as a liquid having a larger specific mass so that a smaller body with buoyancy may be sufficient. It is possible as well that the liquid level, in particular the water level, in the said space is higher or lower than the level of the outside water, due to which the mooring device in a manageable and controlable way can be made independent from the draft resulting from the loading condition.

If the tension-resistant connecting member extends downwardly through the open underside of the protected space then not only a very compact construction is obtained, which s completely protected, but the possibility is obtained as well to close the space at the top and then the space eventually also can be used as a damper whereas ice deposits upon the mooring means can be prevented.

In both cases, with other words with the tension-resistant connecting member inside or outside the protected space, the buoyant body can have a shape such that the liquid displacement increases progressively or decreases respectively upon emersion of the buoyant body or lifting out of the liquid respectively of the body. Morover the buoyant body may be formed by a plurality of bodies which eventually operate in separate spaces and then the construction can be made such that a dampening occurs of the movements of the body or bodies with buyoancy inside the space or spaces respectively. The buoyant body may have a relatively small clearance inside the protected space so that during the up and down movements with respect to the tanker the liquid inside the space always has to be pushed aside and has to flow through a narrow space which throttles the flow so that dampening is obtained by itself.

If there is less space at the bow portion of the vessel to construct in it the protected space then it is possible as well to provide the pivotable connection of the arm with the floating device upon an outrigger extending outboard. The float then is present inside the protected space, the pivot at a distance in front of the bow but above water level and the tension-resistant connection in front of the bow or through the connected space respectively.

From Dutch patent specification No. 165,422 a mooring device is known in which the tanker, by means of an arm, which has been pivoted about a horizontal shaft connected with the tanker, has been connected to a buoy, anchored by means of anchoring chains. According to the invention the arm as well the buoy can be present inside the protected space as long as one takes care that the connection of the anchor chains is present at a level such that during the relative movements of buoy and tanker with respect to each other, the anchoring chains do not come into conflict with the hull of the tanker.

From the published Dutch patent application No. 8100936 a mooring device is known in which the tanker by means of an arm, which has been pivotably about a horizontal shaft connected with the tanker, has been connected with a column with buoyancy in at least the upper part of it and pivotably connected to a bottom anchor.

According to the invention the arm can be present inside the protected space and the column can extend upwardly into said space through the open underside of said space.

Said column can comprise several parts pivotably connected with each other. The connection between column and tanker can be performed in a simple way by controlling the buoyancy of the column such that said column is at a depth allowing to move the tanker with the protected space open at the underside above the column, after which said column can be raised by removing, e.g. ballast.

From the published Dutch patent application No. 7901416 a mooring device is known in which the means for generating a return force are formed by one or more weights which are suspended by means of a tension-resistant connection from an arm rigidly connected to the bow of the tanker, which connection at or adjacent the weights has been coupled with a rigid arm the other end of which at least about a horizontal axis has been pivotably connected to a bottom anchor.

According to the invention the tension resistant connection now can extend through the open lower side of the protected space and be connected to an arm or support which keeps the tension-resistant connection at a distance from the walls of the space. In that case it is possible to function inside a relatively small space.

From the published Dutch patent application Nos. 8202334 and 8202335 a system is known in which the return forces are delivered by one or more weights, which by means of a connection member are suspended from the tanker and which by the intermediance of a rigid arm cooperate with a buoy or tower. The rigid arm can be rigidly connected to the buoy or tower, in which case the connecting member with the weights is guided through guiding openings of the rigid arm, however, the rigid arm also can be pivotably or flexably connected with the boy or tower and the arms can have a rigid connection with the connecting member in which case the weight is present at the connecting member or upon the arms. In both cases the arms can be present at or above water level. The means described in the two Dutch patent applications now according to the present invention can be placed inside the protected space. Then the possibility is obtained to suspend a plurality of weights distributed over the circumference of the space from connecting members belonging to them and connect them with rigid arms directed in different directions and pivotably connected with the turn table of a buoy placed inside the protected space and anchored by means of anchoring chains. The same of course can be done as well with respect to a tower extending into the protected space and this can be a tower pivotably connected at its foot and having buoyancy itself or a column rigidly mounted upon the sea bottom having an upwardly expendable part which extends into the protected space.

One also can use a plurality of weights distributed over the circumference of the space in which case the connecting members with weights are suspended from a ring which, rotatable about a vertical axis, is supported in the tanker and then one can choose again between a connection of the connecting members with the buoy through arms rigidly connected to the buoy, in which case the connecting members are guided through openings of the arms, or by connecting the connecting members to arms which are pivotably connected about horizontal axes to the buoy.

By applying a rotatable ring it is possible to use connecting members with weights which below the vessel hand in the water. The tanker then can rotate around the buoy without the risk that the weights come in conflict with the anchoring chains whereas the return set operation in all positions of the tanker, with respect to the buoy, is sufficiently guaranteed by the fact that the weights are placed according to a circle.

From the published Dutch patent application No. 7614397 a mooring device is known in which the tanker by means of a rigid arm, pivotably connected to the tanker about a horizontal axis, is connected with a floating ring which with respect to a tower, rigidly placed upon the sea bottom, is held in place by means of a ring of weights which on one side by means of connecting members are suspended from the floating ring and on the other side by means of connecting members to an annular member with buoyancy guided upon the tower. According to the invention it now is possible that a column placed upon the sea bottom, extends into the protected space and that the tanker is anchored with respect to the column by means of one or more weight loaded tension members which extend between the tanker and the column, preferably in the form of a ring of weights in the same way as known from the said application No. 7614397. The construction according to the invention, however, is considerably more simple, because instead of a floating ring the connecting members for the weights now are suspended from the side walls of the protected space whereas the other connecting members of the weights may be connected to the column directly without the intermediance of a buoyant body shiftable upon the column or with such a body. it is feasible, in particular to give the column, rigidly placed upon the sea bottom a length which ends below the bottom of the tanker and that upon said column a body, such as a cylinder, is adjustably guided to which body the connecting members are connected. If the tanker has to move away then this quickly can be performed whereas the connection can be made again, whereas adaptations to the draft, if necessary, can be realized in a simple manner as well. In a permanent mooring system in which the tanker normally needs not to move away, the column may extend upwardly into the protected space.

According to the invention it furthermore is possible to provide inside the protected space a yoke or the like device pivotable about a horizontal shaft, which yoke below the pivot axis carries weights and which above the pivot axis has been connected to a tension resistance connection, which through the open under side of the protected space extends towards a bottom anchor. Inside the protected space, so to say a pendulum has been supported the movements of which may be dampened by the water and which at any time the floating device leaves its position, leaves the vertical position and then of course tries to return to it. This pendulum can be made such that it not only acts against horizontal displacements of the floating device but also against vertical movements. Lifting the floating device by the waves then also has as a result that the pendulum with weights is moved away from its vertical position and accordingly will try to oppose the lifting movement.

With almost all embodiments according to the invention all means are present inside the protected space and accordingly there is nothing in front of the bow. The distance to the center of the vessel accordingly is considerably shorter due to which relative movements of the vessel with respect to the mooring or anchoring means are considerably reduced. Due to the face that there is nothing in front of the bow or at most a tension-resistant connection, the problems with respect to e.g. ice movements are reduced considerably as well. By placing the means which generate the return force inside the protected space it now is possible that at least at the bow a row of arms is provided which extend far away outboard and to which vertically downwardly extending chains are attached which extend below water level. Said chains form a kind of curtain. Ice pieces floating towards the vessel move against said curtain and are guided away.

The invention now will be further elucidated with reference to the drawings.

Figure 6:
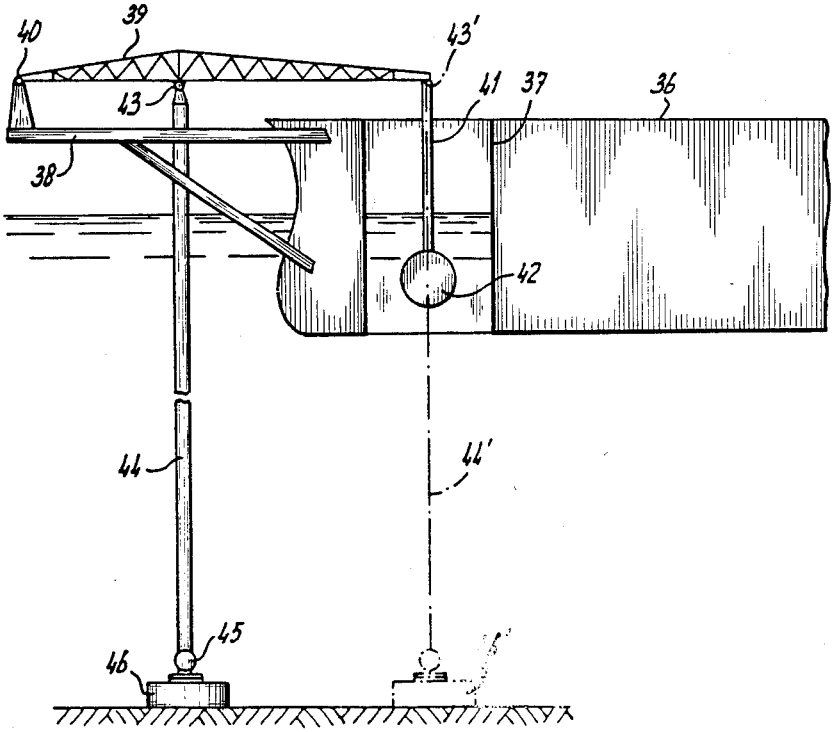

FIG. 6 an embodiment having the pivot point of the arm outboard.

Figure 5:
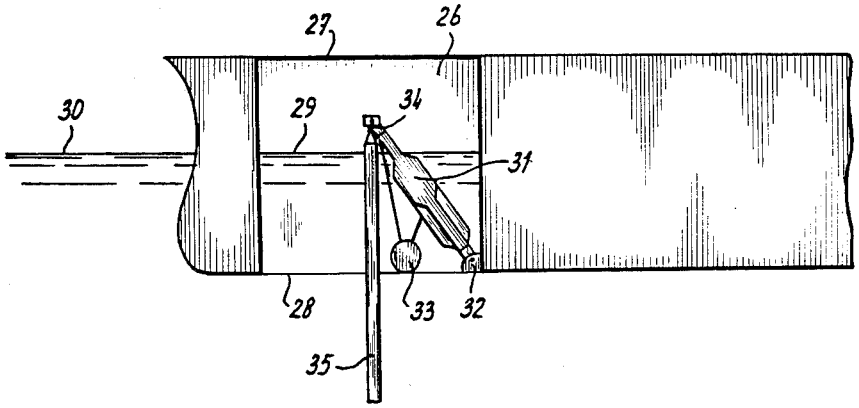
FIG. 5 is a fourth embodiment.
Figure 7:
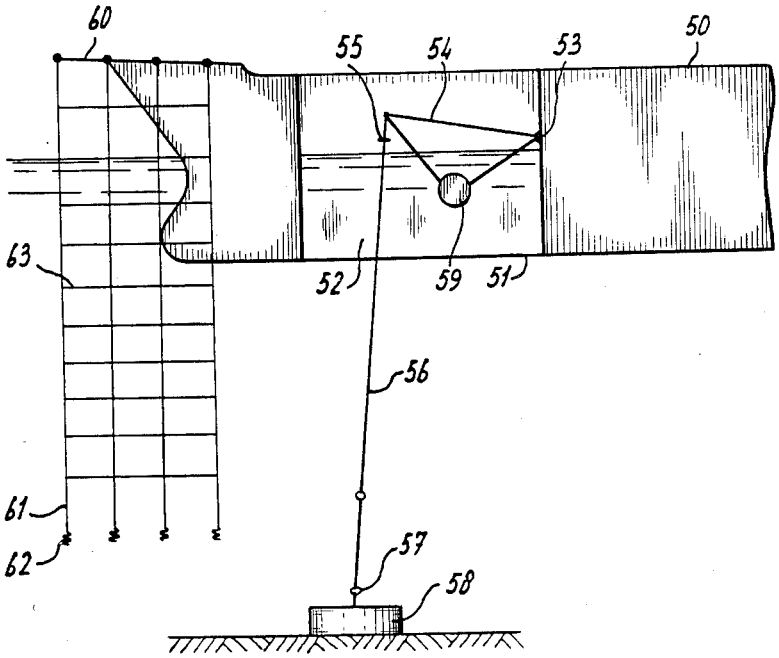

FIG. 7 shows a variant of the embodiment of FIG. 5.

Figure 8:
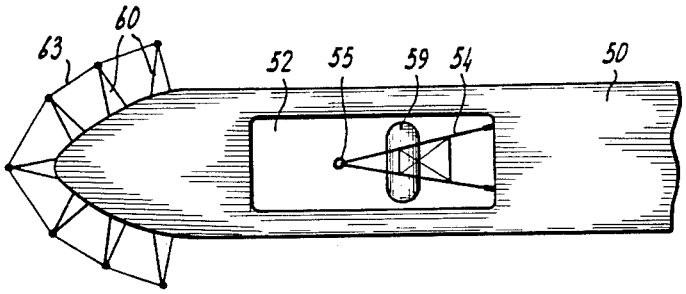

FIG. 8 is a top view of FIG. 7.

FIG. 9 shows again another embodiment with buoy.

Figure 10:
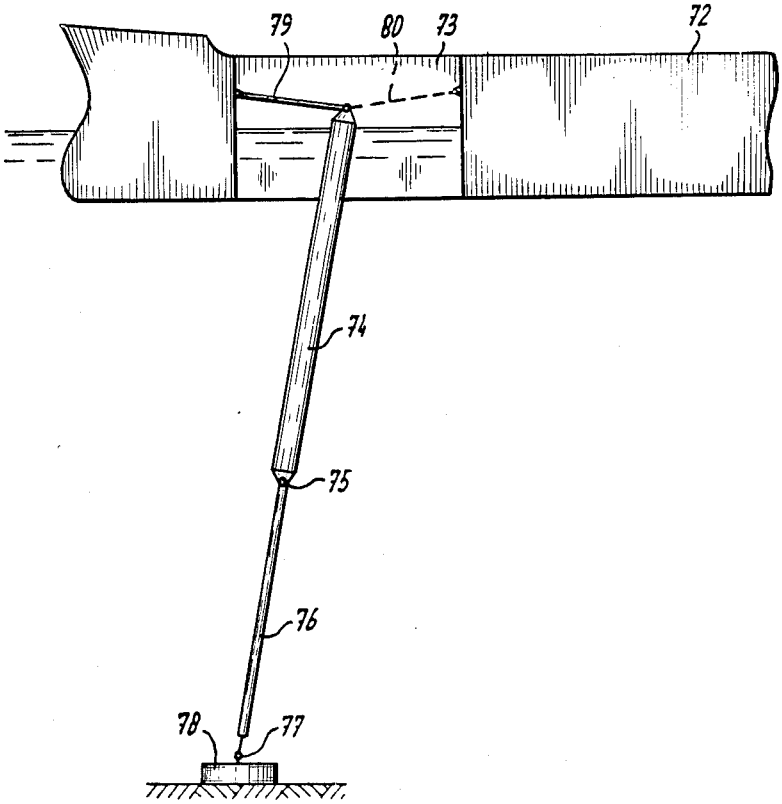

FIG. 10 shows an embodiment which makes use of a pivotable tower.

Figure 11:
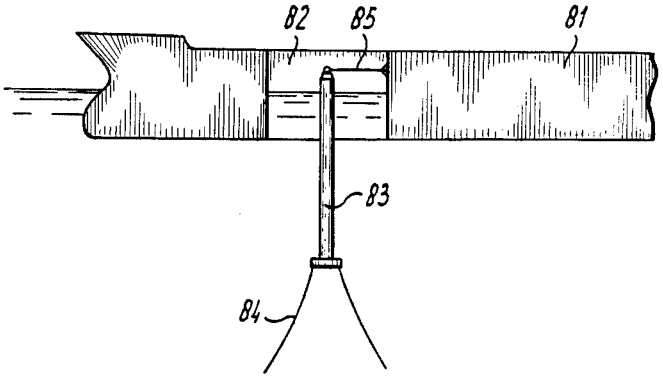

FIG. 11 shows an embodiment which makes use of a cylindrical buoy.

Figure 12:
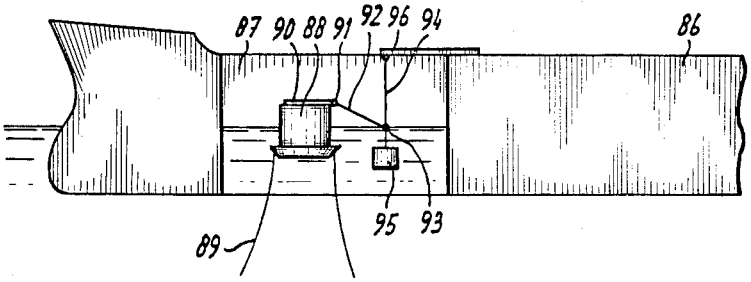

FIG. 12 shows an embodiment with buoy and weight.

Figure 13:
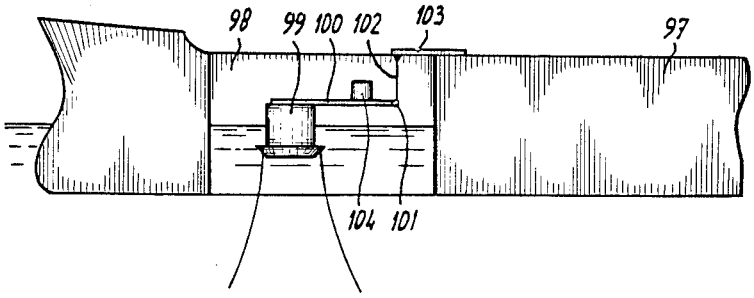

FIG. 13 is a variant of the embodiment of FIG. 12.

Figure 14:
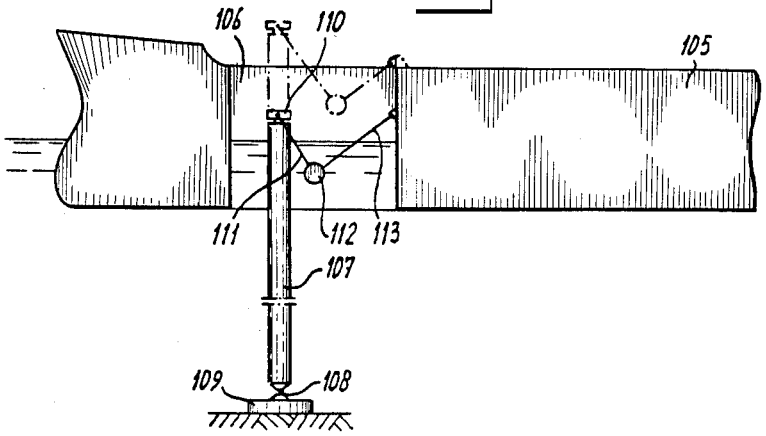

FIG. 14 shows the application of the stabilizing system according to FIG. 12 at a pivotably connected tower.

Figure 15:
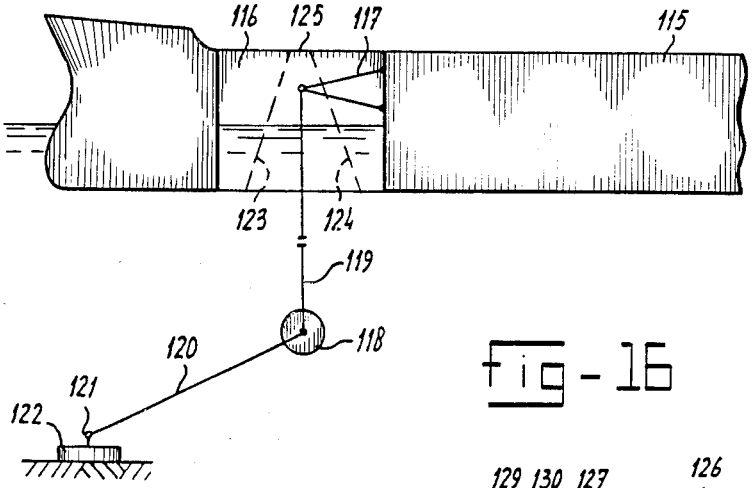

FIG. 15 shows the location of a stabilizing system with weight and a rigid arm pivotably connected to a bottom anchor, said arm having a connection with the tanker with three degrees of freedom.

Figure 16:
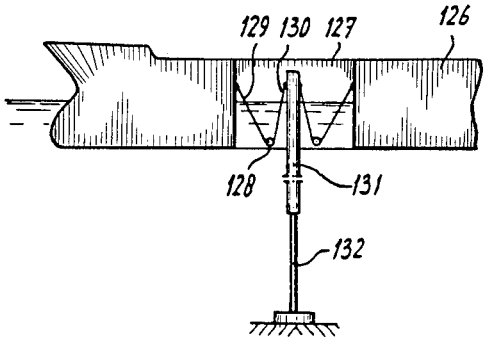

FIG. 16 shows the mooring of the tanker with respect to a column rigidly placed upon the sea bottom.

Figure 17:
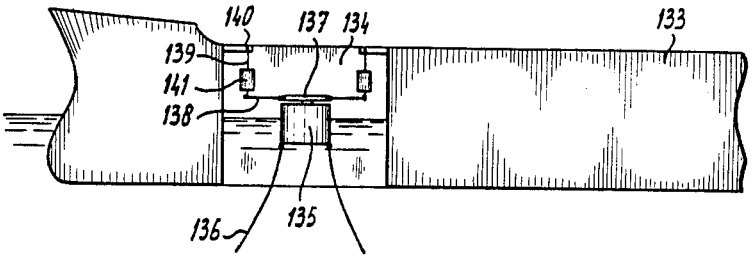

FIG. 17 is a variant of the system of FIG. 13 having a ring of weights.

Figure 18:
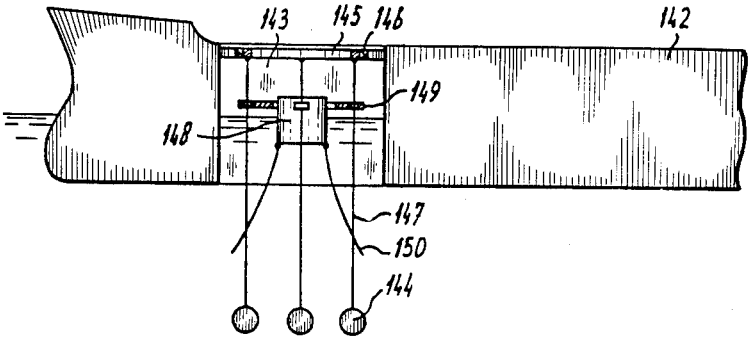

FIG. 18 is a variant of the system according to FIG. 12 having a ring of weights suspended from a rotatable ring.

Figure 19:
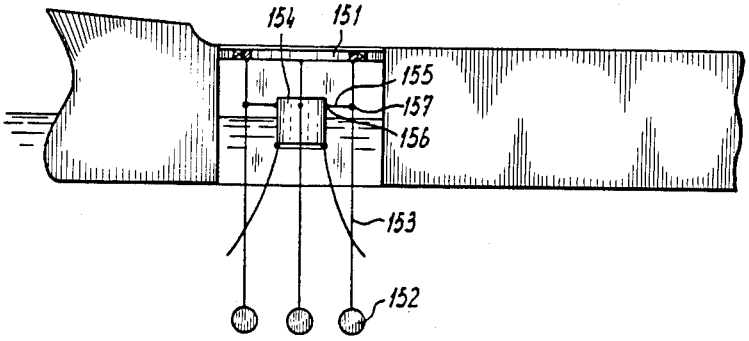

FIG. 19 is a variant of the embodiment of FIG. 18.

Figure 20:
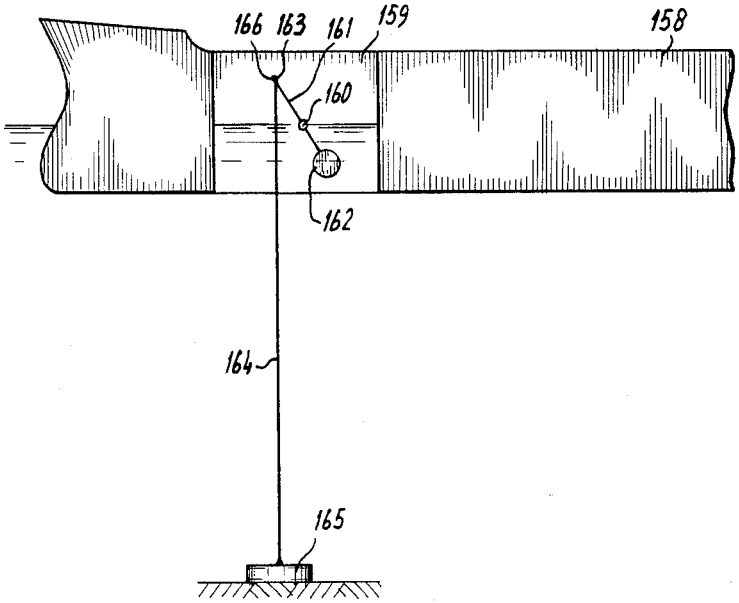

FIG. 20 shows an embodiment having a yoke loaded by a weight and

Figure 21:
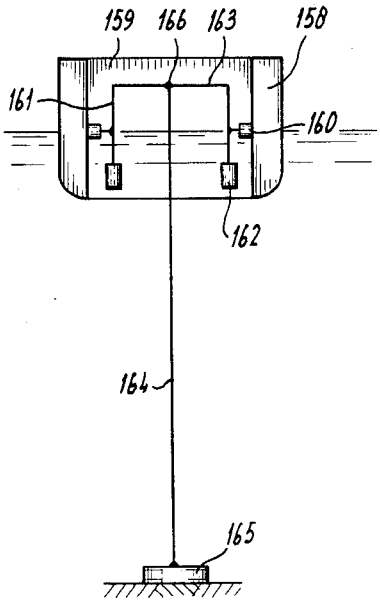

FIG. 21 shows a diagrammatic cross section of the device of FIG. 20.

Figure 1:
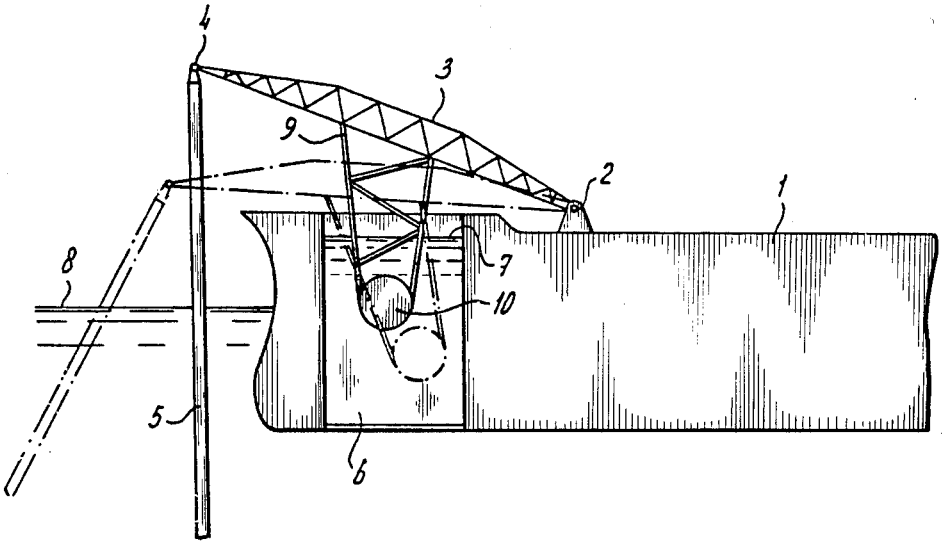
FIG. 1 shows a first embodiment of the mooring device according to the invention.

In the embodiment of FIG. 1 an arm 3 is pivotably connected at 2 upon the tanker 1, which arm at its outer end at 4, in a manner known in connected by means of a cardan joint and a pivot having a vertical axis of rotation to a tension loaded connection 5 the lower end of which being connected to an anchor.

In the front part of the tanker a hollow space 6 is formed the bottom of which is closed and in said space there is a liquid level 7 which in most cases is higher than the outer level 8. The arm 3 carries a frame 9 with a float 10. Said float in a manner known is completely submerged.

With interrupted lines has been indicated the position of the relative parts in case the tanker 1 is displaced.

Figure 2:
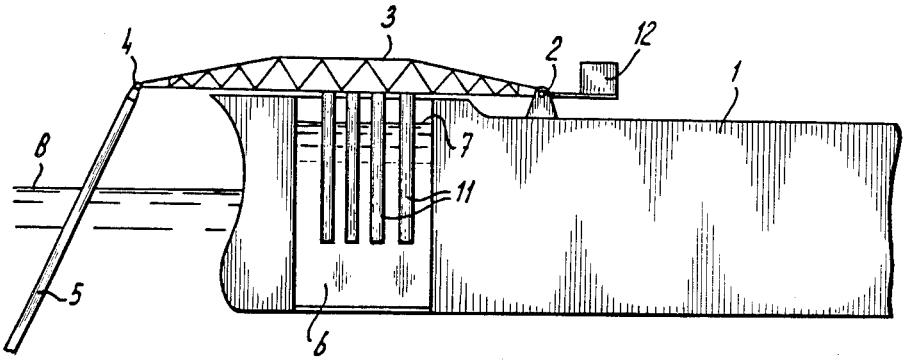
FIG. 2 shows another embodiment.

The embodiment of FIG. 2 differs from the one according to FIG. 1 only in that the body with buoyancy comprises a plurality of closed casings 11 with space inbetween and extending up to the arm 3. Upon further emersion a larger quantity is displaced so that he return force increases. With the embodiment of FIG. 1 as well as with the embodiment of FIG. 2 the bottom of the space 6 is closed.

In both embodiments the arm 3 may have been provided with a counterweight 12.

Figure 3:
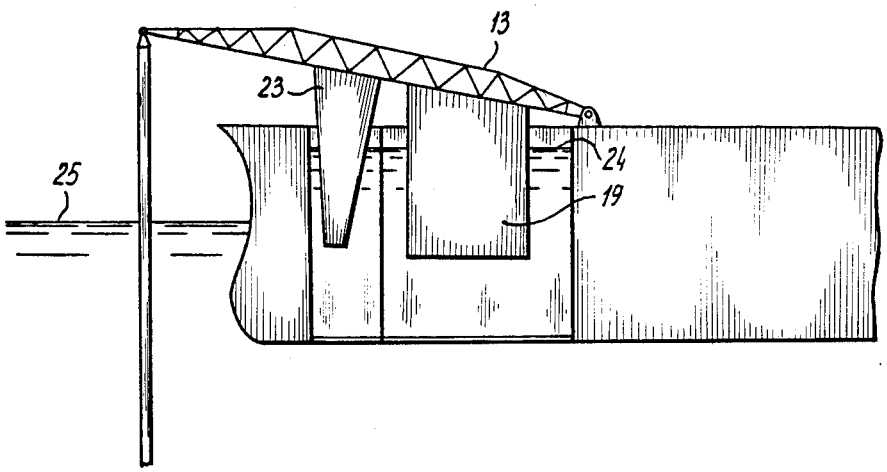
FIG. 3 shows a third embodiment.
Figure 4:
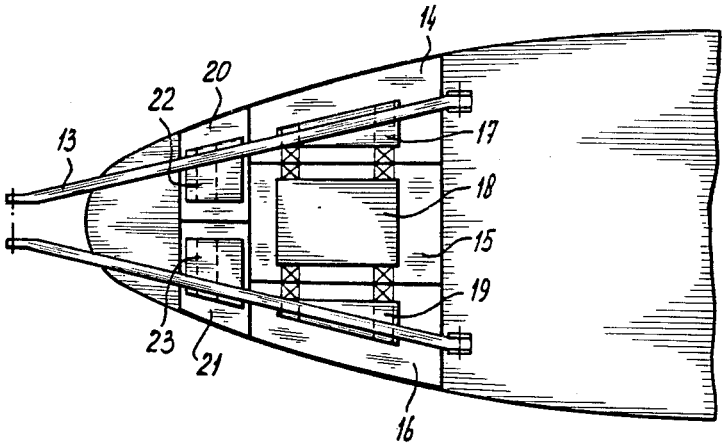
FIG. 4 is a top view of FIG. 3.

In the embodiment of FIGS. 3 and 4 a plurality of bodies with buoyancy have been connected to the arm 13. The space is divided into several spaces 14,15, 16 in which there are bodies 17,18,19 and in front of said spaces 14 and 16 incl. there still are two spaces 20 and 21 with bodies 22 and 23 which, as appears from FIG. 3, have a cross section such that upon ermersion an progressive quantity of water is displaced and indeed more than would be the case if the cross section would have remained the same.

In all spaces 17,18,19 and 20 and 21 respectively the liquid level 24 is higher than the outer level 25.

The same principle, however, is possible as well in case the spaces at the underside are in open connection with the surroundings and the liquid level would be equal to the outside level. This holds true as well for the embodiment of FIGS. 1 and 2.

In the embodiment of FIG. 5 the protected space 26 is closed at the top at 27 and is open at 28 at the underside. By means of ventilation valves the pressure in the space 26 can be controlled and accordingly the water level. The liquid level 29 is as indicated at the same level as the outer level 30. In said space 26 there is an arm 31, which may have buoyancy, is connected pivotably at 32 and is provided with a float 33. The other end 34 again in a manner known has a universal joint with the tension-resistant connection 35.

In the embodiment of FIG. 6 the tanker 36 has an open space 37 which is open at the top and bottom. The tanker has an forwardly extending outrigger 38 upon which the arm 39 is pivotably connected at 40. The other end of the arm through the connection 41 carries the completely submerged float 42.

The tension-resistant connection is connected to the arm 39 at 43 and said connection 44 in a manner known is connected with its lower end by means of a cardan joint 45 to the anchor 46.

As a variant of the embodiment shown in FIG. 6 it is possible to connect the tension-resistant connection 44 at 43' to the arm 39 and by means of the float 42 along the interrupted line 44' connected to the anchor 46'.

The embodiment of FIG. 7 shows a tanker 50 with a space 52 which at least at the underside at 51 is open and which is filled with the outside water. At 53 an arm 54 pivotable about a horizontal shaft is connected to the rear wall of the space 52 and said arm by means of a universal joint and the not shown rotatable swivel belonging to it is connected with a tension-resistant connection 56 which at 57 through a cardan joint is connected with a bottom anchor 58. The arm 54 has a float 59, which keeps the tension-resistant connection 56 under tension. If the tanker is displaced such that the tension-resistant connection 56 extends at an angle with the vertical then the force present in it, will generate a return force in dependence of the angular position and this will bring the tanker back.

From FIG. 8 one can see that the arm 54 may have the form of an A-frame.

This embodiment has been provided at the bow with a plurality of arms 60 from which chains 61 hangs downwardly which, it desired, can be provided with weights 62 and eventually are interconnected by horizontal connectors 63. Said chains form a screen or curtain in front of the bow of the vessel so that eventual ice pieces can be rejected.

Of course such a screen also can be applied along the sides or along the rearside of the vessl so that a protection all around is possible except there where another vessel should be allowed to moor. However, the arms easily can be made such that they can swing inboard.

Figure 9:
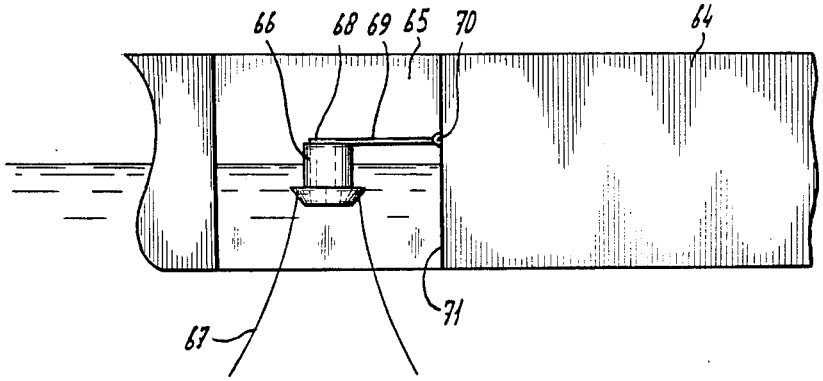

The embodiment of FIG. 9 shows a tanker 64 with protected open space 65 filled with outside water. In said space 65 there is a buoy 66 secured by means of anchor chains 67, which buoy has a turn table 68 rotatable about a vertical axis which turn table in the case shown forms a unit with the rigid arm 69 which at 70, rotatable about a horizontal shaft is connected to the wall 71 of the protected space inside the hull of the tanker. This construction in itself is known from Dutch patent specification No. 165,422, but then is placed in front of the bow of the vessel.

With the embodiment of FIG. 10 the tanker 72 has an open space 73 into which extends a tower 74 the upper part of which having buoyancy and comprises a cylinder which at the lower end at 75 is pivotably connected to a rod or the like 76 which in turn by means of a cardan joint 77 is connected with a soil anchor 78.

The tower through a rigid arm 79 is pivotably connected with the tanker. The arm 79 is directed forwardly but also can be directed rearwardly as shown with the interrupted line 80.

The embodiment of FIG. 11 comprises again a tanker 81 having an open space 82 within which a cylindrical buoy 83 floats, which with anchor chains 84 is held in its place. By means of a rigid arm 85, pivotably connected to the buoy and to the tanker the buoy 83 is connected with the tanker. The return force in this case is derived from the weight of the chains or the buoyancy of the buoy 83 or the combination of both means.

With the embodiment of FIG. 12 the tanker 86 again has an open space 87 within which there is a buoy 88, anchored by means of anchor chains 89. The said buoy has a turn table 90 to which pivotable at 91 a rigid arm 92 has been connected the outer end of which at 93 has been attached to a flexible connecting member 94 carrying a weight 95 and secured to a rigid arm 96 of the tanker. Upon displacements of the tanker with respect to the buoy first the angular positions of the connecting member 94 will be changed due to which a return force is generated. This principle can be found in Dutch patent application No. 8202334.

FIG. 13 shows an embodiment with a tanker 97 with open space 89 and in said space a buoy 99 to which pivotable about a vertical axis a rigid arm 100 has been connected which in turn is pivotably connected at 101 to a connecting member 102 which has been suspended from a rigid arm 103 connected to the tanker. At 104 there is a weight. Again in this case the return force primarily is delivered by the changement of the angular position of the connecting member 102 and subsequently by the anchor chains.

The embodiment of FIG. 14 shows a tanker 105 with open space 106.

In said open space extends a tower 107 the foot of which at 108 has been connected to a soil anchor 109 by means of a cardan joint. Said tower carries a turn table 110 with a yoke to which rods 111 are connected pivotably, which rods carry weights 112 and which further by means of rods or chains 113 has been connected to the wall 114 of the space 106. The principle of said mooring method is known from British specification No. 20 19 800, however, it applied to the present invention, requires considerably less space. Instead of a tower with buoyancy and having its foot pivotably connected also a tower can be applied placed rigidly upon the bottom. Further the tower may extend upwardly that far that the weight 112 is above water level as indicated with interrupted lines. The weight then can be smaller.

FIG. 15 shows a mooring device comprising a tanker 115 with open space 116 into which extends a rigid arm 117 carrying a weight 118 by means of a tension-resistant connection 119. The weight further has been connected to a rigid arm 120 which pivotable about a horiontal axis 121 has been secured to a soil anchor 122. The principle of this known, e.g. from the published Dutch patent application No. 7802200. It will be clear, however, that the placing in accordance with the invention is considerably more favourable.

The open space 116 moreover can have an adapted shape as e.g. indicated with the lines 123, 124 and said clock-shaped space can be closed at the top at 125.

FIG. 16 shows a tanker 126 with open space 127 within which a ring of weights 128 has been suspended, to know with connecting members 129 to the walls of the open space and with connecting members 130 to a sleeve 131 placed over a column 132 rigidly mounted upon the sea bottom. Said sleeve 132 can be adjustable in height and easily can be removed by lifting it with the air of one or the other hoisting device after which the tanker can move away.

With the embodiment of FIG. 17 an open space 134 has been provided in the tanker 133 within which there is a buoy 135 with anchor chains 136. Said buoy has a turntable 137 to which rigid arms 138 are pivotably connected, e.g. four or six, regularly distributed over the circumference of the turn table, and the outer ends of said arms 138 are connected with connecting members 139 which at 140 are suspended from the tanker and carry weights 141. This device operates according to the principle of the device according to FIG. 12, however, with the advantage of a more regular distribution of the mass of the weights of the entire device.

With the embodiment of FIG. 18 in the tanker 142 in the open space 143 a number of weights 144 are suspended from a ring 145 which by means of an axial radial bearing 146 is rotatably supported in the tanker. The connecting members 147 by means of which the weights 144 are suspended from the rotatably ring 145, extends through a plurality of rigid arms 149 regularly distributed about the circumference of a buoy 148. The buoy 148 itself is anchored in a known manner by means of anchor chains 150 and the weights hang inbetween. The tanker now can rotate about buoy and weights without the weight coming into conflict with the anchor chains whereas the same return force can be generated due to the regular distribution of the weights over the circumference of the open space and this in any angular position of the tanker.

The embodiment of FIG. 19 differs from the one of FIG. 18 in that the weights 152 suspended from the rotatable ring 151 by means of the connecting members 153 are connected with the buoy 154 by rigid arms 155 which on one hand are pivotably connected with the buoy at 156 and on the other hand at 157 with the connecting member.

Also in this embodiment the tanker is free to swing around buoy, anchor chains and weights.

FIGS. 20 and 21 relate to an embodiment in which the tanker 158 has an open space 159 in which, rotatable about a horizontal shaft 160, a yoke 161 has been mounted which yoke at its lower end carries weights 162 and of which the upper end at 166 through a cross yoke 163 has been connected with a tension-resistant member 164 which is connected to a soil anchor 165.

The yoke 163 has a connecting point 166 with the tension-resistant connection 164 preferably at a place such that in the position of the yoke 161, as shown in FIG. 20, there is a pretension in the connection 164. This is necessary to allow vertical movements of the tanker and to have immediately available a sufficiently large return force. Also with said embodiment the weights can be above water level.

It will be clear that the open space in the tanker can have another form than the form shown in the drawings, to know a form which in dependence of the system applied has been adapted such that with the smallest possible volume of the open space the movements of the relative parts with respect to each other are possible.

I claim:

1. In a mooring device comprising a tanker floating on the surface of a body of water and having an arm pivotably connected to the vessel at one point on the arm, a tension-resistant connecting member connected to said arm at a second point spaced from said one point and extending toward the bottom of the body of water and connected to a bottom anchor, and a body having positive buoyancy in water and whose buoyancy exerts an upward force to maintain said connecting member under tension; the improvement in which the ship has a hull that has interior side walls that laterally surround a protected space that contains a liquid in which said body is at least partially submerged and has positive buoyancy, said body having large clearance with respect to said side walls, said protected space extending above and below the surface of said body of water.

2. Mooring device as claimed in claim 1, in which the protected space is closed at the underside.

3. Mooring device as claimed in claim 1, in which in said space there is a liquid having a specific mass which is different from the specific mass of the outside water.

4. Mooring device as claimed in claim 1, in which there is water in the protected space the level of which is higher or lower than the level of the outside water.

5. Mooring device as claimed in claim 1, in which the arm and the body with buoyancy are placed inside the protected space and the tensionresistant connection with the bottom anchor extends downwardly through the open underside of the protected space.

6. Mooring device as claimed in 1, in which, the body with buoyancy has a shape such that the liquid displacement increases progressively or decreases respectively upon emersion of the buoyant body or lifting out of the liquid respectively of the body.

7. Mooring device as claimed in claim 1, in which, the body with buoyancy comprises a plurality of bodies.

8. Mooring device as claimed in claim 7, in which said bodies are present in separate spaces.

9. Mooring device as claimed in claim 1, in which, means are provided which dampen the movement of the body with buoyancy in the said space.

10. Mooring device as claimed in claim 1, in which, the pivotable connection of the arm with tanker is on an outrigger extending outboard.

11. Mooring device as claimed in claim 1 in which the tanker by means of said arm pivotably connected with it about a horizontal shaft has been connected with a buoy which is anchored by means of anchoring chains, and in which the arm and the buoy both are present inside the protected space.

12. Mooring device as claimed in claim 1 in which the tanker, by means of said arm which is pivotably connected about a horizontal shaft with the tanker, is connected to a column having buoyancy in at least the upper part and connected pivotably to a bottom anchor, and in which the arm is inside the protected space and the column extends upwardly into said space through the open underside of the said space.

13. A mooring device as claimed in claim 1, said protected space being downwardly open to said body of water.

14. A mooring device as claimed in claim 13, said tension-resistant connecting member extending up into said protected space.

* * * * *